US007538142B2

(12) United States Patent
Lortz et al.

(10) Patent No.: US 7,538,142 B2
(45) Date of Patent: May 26, 2009

(54) METHOD AND DEVICE FOR PRODUCING DISPERSIONS

(75) Inventors: Wolfgang Lortz, Wächtersbach (DE); Christoph Batz-Sohn, Hanau-Mittelbuchen (DE)

(73) Assignee: Degussa AG, Dusseldorf (DE)

( * ) Notice: Subject to any disclaimer, the term of this patent is extended or adjusted under 35 U.S.C. 154(b) by 251 days.

(21) Appl. No.: 10/584,464

(22) PCT Filed: Dec. 1, 2004

(86) PCT No.: PCT/EP2004/013609

§ 371 (c)(1),
(2), (4) Date: Jun. 22, 2006

(87) PCT Pub. No.: WO2005/063369

PCT Pub. Date: Jul. 14, 2005

(65) Prior Publication Data

US 2008/0051473 A1 Feb. 28, 2008

(30) Foreign Application Priority Data

Dec. 23, 2003 (DE) ..... 103 60 766

(51) Int. Cl.
*B01F 5/02* (2006.01)
*B01F 3/10* (2006.01)
*B01F 5/10* (2006.01)

(52) U.S. Cl. ..... 516/77; 222/226; 241/5; 241/16; 424/400

(58) Field of Classification Search ..... 516/77; 241/5; 424/400
See application file for complete search history.

(56) References Cited

U.S. PATENT DOCUMENTS

| | | | | |
|---|---|---|---|---|
| 4,908,154 | A | 3/1990 | Cook et al. | |
| 5,927,852 | A * | 7/1999 | Serafin | 366/144 |
| 6,135,628 | A | 10/2000 | DeStefano et al. | |
| 6,991,190 | B2 * | 1/2006 | Lortz et al. | 241/5 |
| 2003/0006203 | A1 | 1/2003 | Romanyszyn et al. | |

FOREIGN PATENT DOCUMENTS

| | | |
|---|---|---|
| GB | 2 063 695 | 6/1981 |

* cited by examiner

*Primary Examiner*—Chun-Cheng Wang
(74) *Attorney, Agent, or Firm*—Oblon, Spivak, McClelland, Maier & Neustadt, P.C.

(57) ABSTRACT

A method and device for producing a finely divided dispersion of solids having a mean particle size of 10 nm to 10 µm, in which at least two flows of a predispersion are sprayed by means of pumps, preferably high-pressure pumps, through one nozzle each into a grinding chamber enclosed by a reactor housing onto a collision point, wherein the grinding chamber is flooded with the predispersion and the finally divided dispersion is removed from the grinding chamber by the overpressure of the predispersion continuing to flow into the grinding chamber.

8 Claims, No Drawings

METHOD AND DEVICE FOR PRODUCING DISPERSIONS

The invention relates to a method and a device for producing a finely divided, stable dispersion of solids having a mean particle size of 10 nm to 10 μm, in which at least two flows of a predispersion are sprayed by means of pumps, preferably high-pressure pumps, through one nozzle each into a grinding chamber enclosed by a reactor housing onto a collision point, wherein the grinding chamber is flooded with predispersion and the finaly divided dispersion is removed from the grinding chamber by the overpressure of the predispersion continuing to flow into the grinding chamber.

Devices, such as ball mills or agitating ball mills, are available for producing finely divided dispersions. A disadvantage of said devices is the abrasion of the grinding bodies used, for example of glass, ceramic, metal or sand. Said abrasion limits the use of the dispersions produced therewith in areas that tolerate only slight contaminations, such as, for example, the polishing of sensitive surfaces.

Higher energy inputs are possible with a planetary compounder/mixer. However, the efficiency of this system is tied to an adequately high viscosity of the mixture processed in order to introduce the high shearing energies necessary to break down the particles.

Although very finely divided dispersions can be produced with high-pressure homogenizers in which a predispersion under high pressure impinges on hardened wall regions of the chamber, it has emerged that the chamber of such a device is subject to severe wear despite the hardening. The division of the predispersion into two flows that are decompressed via a nozzle and strike one another precisely reduces the abrasion, but does not solve the problem. In particular, the centring of the predispersions directed at one another is difficult. Such a method is described, for example, in EP-A-766997.

The abrasion in the production of dispersions is markedly reduced if the divided predispersion flows that are under high pressure are decompressed onto a common collision point that is located in a gas-filled grinding chamber remote from material. This arrangement is intended to minimize the cavitation at material walls in contrast to the above-cited high-pressure devices that operate in a grinding chamber filled with a liquid. In this case, the gas flow also takes on the task of transporting the dispersion out of the grinding chamber and of cooling the dispersion (EP-B-1165224).

A disadvantage of this method is the working-up of the gas/dispersion mixtures. In order to achieve economically reasonable throughputs, large quantities of gas have to be used. The removal of said gas requires an increased equipment expenditure, such as, for example, suitably dimensioned gas removers. The thermal conductivity, which is reduced as a result of the high proportion of gas requires more greatly dimensioned and, consequently, more expensive cooling devices in the event of cooling of the mixture possibly being necessary.

This method is particularly disadvantageous in cases where surfactants have been added to the predispersion as dispersion agents. The gas introduced may result in an undesirable foam formation that may make the working-up of the dispersion very difficult. The addition of defoaming agents is unsuitable for many dispersion applications since these additives may have an adverse effect in the application of dispersions.

German Patent DE10204470C1 describes the use of water vapour as gas. The collision of the particles to be dispersed also takes place in this case in the space remote from material. The use of water vapour can avoid the disadvantages of the method in accordance with EP-B-1165224 in which large amounts of gas have to be removed from the reaction mixture. Nevertheless, even in the case of the method DE0010204470C1 it emerges that the maintenance of a gas atmosphere during the dispersion does not make economical sense.

The object of the invention is to provide a method and a device for producing a finely divided dispersion of solids having a mean particle size of 10 nm to 10 μm that avoids the disadvantages of the prior art. In particular, the method is intended to contribute to minimizing the wear of the dispersing device, minimizing the introduction of contaminants as a result of abrasion and to permit a simple and economical isolation of the dispersion after it has been dispersed.

Surprisingly, it has now been found that the object is achieved by a method in which at least two flows of a predispersion are sprayed by means of pumps, preferably high pressure pumps, through one nozzle each into a grinding chamber enclosed by a reactor housing onto a collision point, wherein the grinding chamber is flooded with the predispersion and the finaly divided dispersion is removed from the reaction chamber by the overpressure of the predispersion continuing to flow into the grinding chamber.

The invention is surprising since the person skilled in the art would have been prevented from operating the grinding chamber with it flooded. According to the prior art, such a method would result in an increased material wear. It was possible to show, however, that the wear rates resulting from the method according to the invention are comparable compared with methods according to the prior art, substantially higher throughputs being capable of being achieved with the method according to the invention.

The method according to the invention comprises the comminution, deagglomeration and deaggregation of solids. Predispersion is to be understood as a dispersion having a mean particle size of not more than 1 mm.

The liquid phase of the predispersion is not restricted. It may consist preferably of water, of organic solvents or of mixtures thereof. The solubility of the particles to be dispersed in the liquid phase is preferably less than 0.1 wt. %.

The predispersion may furthermore contain dispersing agents and/or surfactants known to the person skilled in the art. Examples of this are given in Ullmann's Encyclopaedia of Industrial Chemistry, vol. A8, pages 586 to 599, $5^{th}$ edition.

The proportion of solids in the dispersion used in the method according to the invention may be varied within wide limits between 1 and 70 wt. %. The preferred range is between 10 and 50 wt. % and particularly preferred is the range between 20 and 40 wt. %. In this connection, it is unnecessary for the predispersion to be stable. Without the action of a dispersing device, sedimentation of the solid may occur within a short time. However, it is advantageous in such a case to use the latter immediately after predispersion for the method according to the invention.

In the method according to the invention, the predispersion can be sprayed into the grinding chamber under a pressure of at least 50 bar, preferably more than 500 bar, particularly preferably of 1000 to 4000 bar.

After it has left the grinding chamber, the dispersion may be cooled. Suitable for this purpose are heat exchangers, such as, for example, plate or tubular heat exchangers.

According to the method in accordance with the invention, the finely divided dispersion can after it has left the grinding chamber can be sprayed as such or blended with a predispersion several times into the grinding chamber.

Multiple passage may result in smaller particle sizes in the dispersion.

Organic particles, inorganic particles and/or their mixtures can be used as solids. Organic particles include, for example, organic pigments, powder-coating resins or polymer particles. Inorganic particles include, for example, inorganic pigments, abrasives, fillers, ceramic materials or carbon blacks. The method according to the invention can be used particularly advantageously for dispersing metal oxides, such as aluminum oxide, cerium oxide, titanium dioxide, silicon dioxide, zinc oxide, doped metal oxides and mixed oxides. These may be, for example, metal oxides prepared in a wet-chemical manner or pyrogenically.

To perform the method according to the invention, a device is used in which at least two nozzles each having an associated pump and feedline are provided for spraying the predispersion into a grinding chamber surrounded by a reactor housing onto a common collision point. Furthermore, the reactor housing has an opening through which the dispersion leaves the reactor housing.

It is typical in the case of said device that the colliding jets of the predispersion impinge on one another in a space flooded with liquid. At the collision point of the jets, the hydrodynamic energy of the jets results in the occurrence of high shearing and cavitation forces.

The nozzles can be aligned with a common collision point. They are composed of hard and, consequently, low-wear materials. These include ceramics, such as oxides, carbides, nitrides or mixtures thereof. In particular, aluminum oxide, preferably as sapphire or ruby, diamond and hardened metals are particularly suitable.

The nozzles have bores having a diameter of 0.5-2000 μm, preferably of 10 to 500 μm, particularly preferably of 50 to 200 μm.

In a particularly preferred embodiment, the nozzles have a chemical composition that is identical to the substance to be dispersed or becomes identical as a result of chemical reaction under the dispersion conditions. This measure can avoid the dispersion being contaminated by possible material erosion of the nozzles. Thus, for example, aluminum oxide may be used as nozzle material in dispersing aluminum oxide. It is likewise possible to use a nozzle material that is chemically converted under the dispersion conditions. Thus, for example, a possible erosion of silicon nitride in an ammoniacal silicon dioxide dispersion is converted to silicon dioxide and ammonia.

In a further preferred embodiment, the collision point may be surrounded by a material that is disposed in such a way that, in the event of misalignment of the nozzles, the jet of the predispersion collides with said material. This measure is capable of minimizing wear of the reactor housing as a result of misaligned dispersion jets. A possible arrangement of this material is balls arranged in the form of a tetrahedron. In the event of a misalignment, the dispersion jet collides with the balls and not with the respective walls, situated opposite, of the reactor housing.

As also in the case of the nozzles, the material surrounding the collision point may preferably be identical in its chemical composition to the substance to be dispersed or may become identical as the result of chemical reaction under the dispersion conditions.

EXAMPLES

Analytical Method

The mean secondary-particle size was determined with the Zetasizer 3000 Hsa produced by Malvern.

Example of Alox

Aluminum Oxide Predispersion.

36 kg of fully demineralized water are introduced into a 60 l stainless steel batch tank. 16.5 kg of type C aluminum oxide (supplied by Degussa AG) are sucked in with the aid of an Ystral dispersion and suction mixer (at 4500 rpm) and coarsely predispersed. A pH of 4.5 is established and maintained by adding 50-percent-strength acetic acid during sucking in. After the powder is introduced, the dispersion is completed using an Ystral Type Z 66 rotor/stator continuous homogenizer having four processing rings, a stator slot width of 1 mm and a rotational speed of 11,500 rpm. During this 15-minute dispersion at 11,500 rpm, the pH is adjusted and maintained at a pH of 4.5 by adding further 50-percent-strength acetic acid. A total of 570 g of 50-percent-strength acetic acid was needed and a solids concentration of 30 wt. % was established by adding 1.43 kg of water.

Example of $SiO_2$

Silicon Dioxide Predispersion 53 kg of fully demineralized water and 80 g of 30%-strength KOH solution are introduced into a 60 l stainless-steel batch tank. With the aid of an Ystral dispersion and suction mixer (at 4500 rpm), 8 kg of AEROSIL® 90 powder are sucked in and coarsely predispersed. After introducing the powder, the dispersion is completed using an Ystral Type Z 66 rotor/stator continuous homogenizer having four processing rings, a stator slot width of 1 mm and a rotational speed of 11,500 rpm. During this 15-minute dispersion at 11,500 rpm, the pH is adjusted to and maintained at a pH of 9.5 by adding further KOH solution. In this process, a further 96 g of KOH solution was used and an abrasive-body concentration of 12.5 wt. % was established by adding 2.8 kg of water.

Example of Alox 1

Aluminum Oxide Dispersion—Dispersion in the Flooded Grinding Chamber (In Accordance with the Invention)

The predispersion is ground using a Model HJP-25050 high-pressure homogenizer Ultimaizer system supplied by Sugino Machine Ltd, but with a three-jet chamber instead of the two-jet chamber incorporated in the Ultimaizer system. (The Ultimaizer system is used only as a high-pressure pump.) The three-jet chamber divides the predispersion, which is at high pressure, into three subflows that are each decompressed via a diamond (alox 1) nozzle or an alox 2 monocrystalline corundum (colourless sapphire) nozzle having a diameter of 0.25 mm. The three dispersion jets emerging at a very high velocity meet at a collision point, in which process the desired dispersion/grinding effect is achieved. The collision point is tetrahedrally surrounded by sapphire balls (three base balls each of 8 mm and an upper ball of 10 mm). Since all three liquid jets are situated on a common imaginary plane, the angle with respect to the adjacent beam is 120° in each case. 250 MPa is chosen as the pressure for the grinding of the aluminum oxide predispersion. The dispersion can then be cooled without difficulty with the aid of a conventional heat exchanger. The mean particle size of the particles in the dispersion is 51 nm.

The example of alox 2 is performed analogously to alox 1,but using sapphire as nozzle and ball material. The mean particle size of the particles in the dispersion is 55 nm.

Example of $SiO_2$ 1

Silicon Dioxide Dispersion—Dispersion in the Flooded Grinding Chamber (In Accordance with the Invention)

The predispersion is ground with a Model HJP-25050 Ultimaizer system high-pressure homogenizer supplied by Sugino Machine Limited, but using a three-jet chamber instead of the two-jet chamber incorporated in the Ultimaizer system. (The Ultimaizer system is used only as a high-pressure pump.) The three-jet chamber divides the predispersion, which is at high pressure, into three subflows that are each decompressed via a nozzle having a diameter of 0.25 mm. The three dispersion jets emerging at very high velocity meet at a collision point, in which process the desired dispersion/grinding effect is achieved. The collision point is tetrahedrally surrounded by polycrystalline $Si_3N_4$ balls (three base balls each of 8 mm and an upper ball of 10 mm). Since all three liquid jets are situated on a common imaginary plane, the angle with respect to the adjacent jet is 120° in each case. 250 MPa is chosen as the pressure for grinding the silicon dioxide predispersion. The dispersion can then be cooled without difficulty with the aid of a conventional heat exchanger. The mean particle size of the particles in the dispersion is 163 nm.

The values in the table show that, in the method according to the invention, the dispersion in the flooded grinding chamber results in service lives of the nozzle and ball materials that are comparable to those in a method in which the dispersion is performed in a gas-filled grinding chamber. The particle size achieved is virtually the same.

The wear of the nozzle material can easily be determined from the increasing throughput performance. With as-new nozzles, that is to say an initial nozzle diameter of 0.25 mm and the use of a three-jet chamber, a throughput of approximately 4.3 l/minute is achieved at a pressure of 250 MPa. With progressive wear, the nozzle aperture becomes increasingly greater; the throughput rises. This rise of the throughput performance is, however, limited by the performance of the high-pressure pump. For the same grinding pressure, more predispersion has increasingly to be compressed. Depending on the performance of the high-pressure pump used, the desired pressure cannot, however, be maintained from a certain throughput upwards and the performance limit of the high-pressure pump is reached. In the unit used here, this is the case at approximately 7.3 l/min.

It furthermore also has to be borne in mind that the alignment also does not always remain constant in the case of nozzle apertures that are too considerably expanded since the increase in the nozzle aperture does not occur with radial symmetry. Depending on the alignment of the normally monocrystalline nozzle material, an isotropic dependence of the wear resistance of various crystalline planes may be observed. Thus, in the case of considerably eroded diamond nozzles, hexagonal or even triangular nozzle apertures are obtained.

Since the balls are substantially subjected to stress to a lesser extent than the nozzles since, of course, most of the kinetic energy of the accelerated liquid jets is used up as fragmentation energy and/or transformed into heat at the collision point, it is sufficient for the balls to be inspected when the diamond nozzles are replaced. Incipient wear can easily be detected from a roughening of the ball surface. The balls can then be replaced as a precaution. Since such balls are used to a large extent as, for example, ball-bearing balls in the special ball bearing sector ("chemistry pumps" etc.), a timely replacement is not a large cost factor.

TABLE

Service life of nozzles/balls of the dispersing device(&).

| Example | Substance dispersed | Material Nozzle | Material service life: Balls | Nozzle [h] | Balls [service life of nozzle x] |
|---|---|---|---|---|---|
| Alox 1 | AEROXIDE ® Alu C(#) | Diamond | Sapphire | 195 | min. 10(§) |
| Alox 2 | AEROXIDE ® Alu C | Sapphire | Sapphire | 55 | min. 40 |
| $SiO_2$ 1 | AEROSIL ® 90(*) | Diamond | $Si_3N_4$ | 350 | min. 20 |

(&)Dispersion pressure 250 MPa;
(#)Degussa pyrogenically produced aluminium oxide;
(*)Degussa pyrogenically produced silicon dioxide;
(§)Service life of nozzle x at least 10: at least 10x the service life of the nozzle material, lines 2 and 3 correspondingly.

The invention claimed is:

1. A device for producing a finely divided dispersion, comprising: at least two nozzles for spraying a predispersion, at least two pumps, wherein each of said nozzles have an associated pump, and a grinding chamber surrounded by a reactor housing, wherein the predispersion is fed onto a common collision point and the dispersion leaves the minding chamber through an opening in the reactor housing wherein the collision point in the device is surrounded by balls.

2. The device according to claim 1, wherein the nozzles can be aligned with a common collision point.

3. The device according to claim 1, wherein the nozzles are composed of oxides, carbides, nitrides, diamond or mixtures thereof.

4. The device according to claim 1, wherein the nozzles have bores having a diameter of 0.5-2000 μm.

5. The device according to claim 1, wherein the nozzles are identical in their chemical composition with the substance to be dispersed or become identical as a result of chemical reaction under the dispersion conditions.

6. The device according to claim 1, wherein the collision point is surrounded by said balls that are disposed in such a way that, in the event of a misalignment of the nozzles, the predispersion jet collides with said balls.

7. The device according to claim 6, wherein the balls surrounding the collision point are identical in its chemical composition to the substance to be dispersed or becomes identical as a result of chemical reaction under the dispersion conditions.

8. The device of claim 1, wherein the balls are arranged in a form of a tetrahedron around the collision point.

* * * * *